US005799512A

United States Patent [19]

Lee et al.

[11] Patent Number: 5,799,512

[45] Date of Patent: Sep. 1, 1998

[54] BALANCING DEVICE FOR DRUM WASHING MACHINE

[75] Inventors: Hyun-Moo Lee, Suwon; Geum-Chan Lee, Seoul, both of Rep. of Korea

[73] Assignee: Samsung Electronics Co., Ltd., Suwon, Rep. of Korea

[21] Appl. No.: 856,085

[22] Filed: May 14, 1997

[30] Foreign Application Priority Data

May 30, 1996 [KR] Rep. of Korea ..... 96-13840
May 23, 1996 [KR] Rep. of Korea ..... 96-17746

[51] Int. Cl.[6] ..... D06F 37/22

[52] U.S. Cl. ..... 68/23.2; 74/573 F

[58] Field of Search ..... 68/23.2; 210/144, 210/363, 364; 74/573 F, 573 R

[56] References Cited

U.S. PATENT DOCUMENTS

| | | | |
|---|---|---|---|
| 3,733,923 | 5/1973 | Goodrich et al. | 74/573 R |
| 4,044,626 | 8/1977 | Hayashi et al. | 210/144 X |
| 4,787,132 | 11/1988 | Kilgore | 74/573 F X |

*Primary Examiner*—Philip R. Coe
*Attorney, Agent, or Firm*—Burns, Doane, Swecker & Mathis, L.L.P.

[57] ABSTRACT

A drum washing machine includes a tub suspended in a housing, and a spin basket rotatably mounted in the tub. Each spin basket includes oil-filled races that are coaxial with the spin basket, a plurality of balls movable in the races, and oil disposed in the races. The oil is introduced into each race through an oil supply hole while forcing air out through an air vent which is angularly spaced from the oil supply hole, e.g. by 90 degrees.

4 Claims, 4 Drawing Sheets

BALANCING DEVICE FOR DRUM WASHING MACHINE

BACKGROUND OF THE INVENTION

The present invention generally relates to a balancing device for a drum washing machine. More particularly, it relates to a balancing device for a drum washing machine.

A conventional drum washing machine is an electronic appliance that washes clothes with the suds produced by the rotation of its drum-shaped spin basket. With the conventional drum washing machine, washing, rinsing and hydro-extracting tasks are automatically carried out according to a prescribed program. After the washing and rinsing of the clothes, excess water is removed therefrom by centrifugal force created by the spin basket rotating at high speeds during the hydro-extracting process. Because abnormal vibrations and noise may be produced by the clothes being unevenly arranged in the spin basket at this time, a balancing device is essential for the smooth operation of a drum washing machine.

FIG. 4 is a perspective view of a conventional drum washing machine with a balancing device.

Referring to FIG. 4, the drum washing machine includes a housing 1, a tub 3 suspended by suspension springs 4 in the housing 1, and a spin basket 2 rotatably installed in the tub 3. The drum washing machine also includes a shock absorbing arm 5 that supports the spin basket lower portion.

The spin basket 2 is rotated by an electric motor 6 installed on the bottom of the housing 1. A pulley (not illustrated) is provided to the rear of the spin basket 2, and is connected to the driving motor 6 by a belt (not illustrated), so that the pulley receives the rotating force of the driving motor 6. The spin basket 2 includes a plurality of small holes 7 uniformly formed on its surface, and a plurality of lifters 8 protruding inward and spaced a predetermined distance away from each other. Water that is removed from clothes in the spin basket 2 by centrifugal force flows into the tub 3 through the small holes 7, and the lifters 8 help to raise and drop the laundry and water during the rotation of the spin basket 2.

In order to prevent the generation of vibration during the washing/hydro-extracting process, counterweights, each of predetermined weight, are attached to the tub 3. An 11.4 kg front counterweight **9*a* is provided to the front of the tub 3, and a 12.2 kg upper counterweight 9*b* is mounted on the top surface of the tub 3. These counterweights 9*a* and 9*b* are made from cast iron and are joined to the tub 3 by bolts 9*c***.

In the conventional drum washing machine, the vibrations, created by the uneven distribution of laundry in the spin basket 2, are directly transmitted to the tub 3, and the counterweights **9*a* and 9*b* counteract the vibration. Unfortunately, it is necessary for the counterweights 9*a*,9*b*** to be significantly heavy to function properly. Consequently, their weight precludes an easy installation and increases transportation costs.

SUMMARY OF THE INVENTION

The present invention concerns a balancing device for a drum washing machine that can obviate the above-described problems and disadvantages of the conventional art.

It is the first objective of the present invention to provide a balancing device for a drum washing machine which is realized as races that are provided to both sides of the washing machine's spin basket, and balls which are seated in each race in order to dynamically counteract imbalances created due to the uneven distribution of laundry in the washing machine's spin basket during rotation.

It is the second objective of the present invention to provide a balancing device for a drum washing machine which includes races, balls seated in each race, oil held in each race, and oil supply hole and air vent hole formed on each race to be a set angle away from each other so as to facilitate the oil supply process.

It is the third objective of the present invention to provide a balancing device for a drum washing machine which is of a construction that allows smooth movement of the balls in the races.

In order to obtain the aforementioned objectives, there is disclosed a balancing device for a drum washing machine including: a tub suspended in a housing; a spin basket formed in the tub to be rotatable, which comprises oil-filled races formed in the spin basket that are concentric with the spin basket, a plurality of balls seated in the races, and oil supply hole and air vent hole placed 90° from each other on the respective race with respective to the spin basket's center of rotation.

Each of the races consists of a ceiling surface, a bottom, and side walls. The air supply hole is formed on one side of the race, and the vertical distance between the holes and the bottom of the race is shorter than the ball's radius.

DETAILED DESCRIPTION OF A PREFERRED EMBODIMENT

A preferred embodiment of the present invention will now be described in detail with reference to the accompanying drawings.

Figure 1:
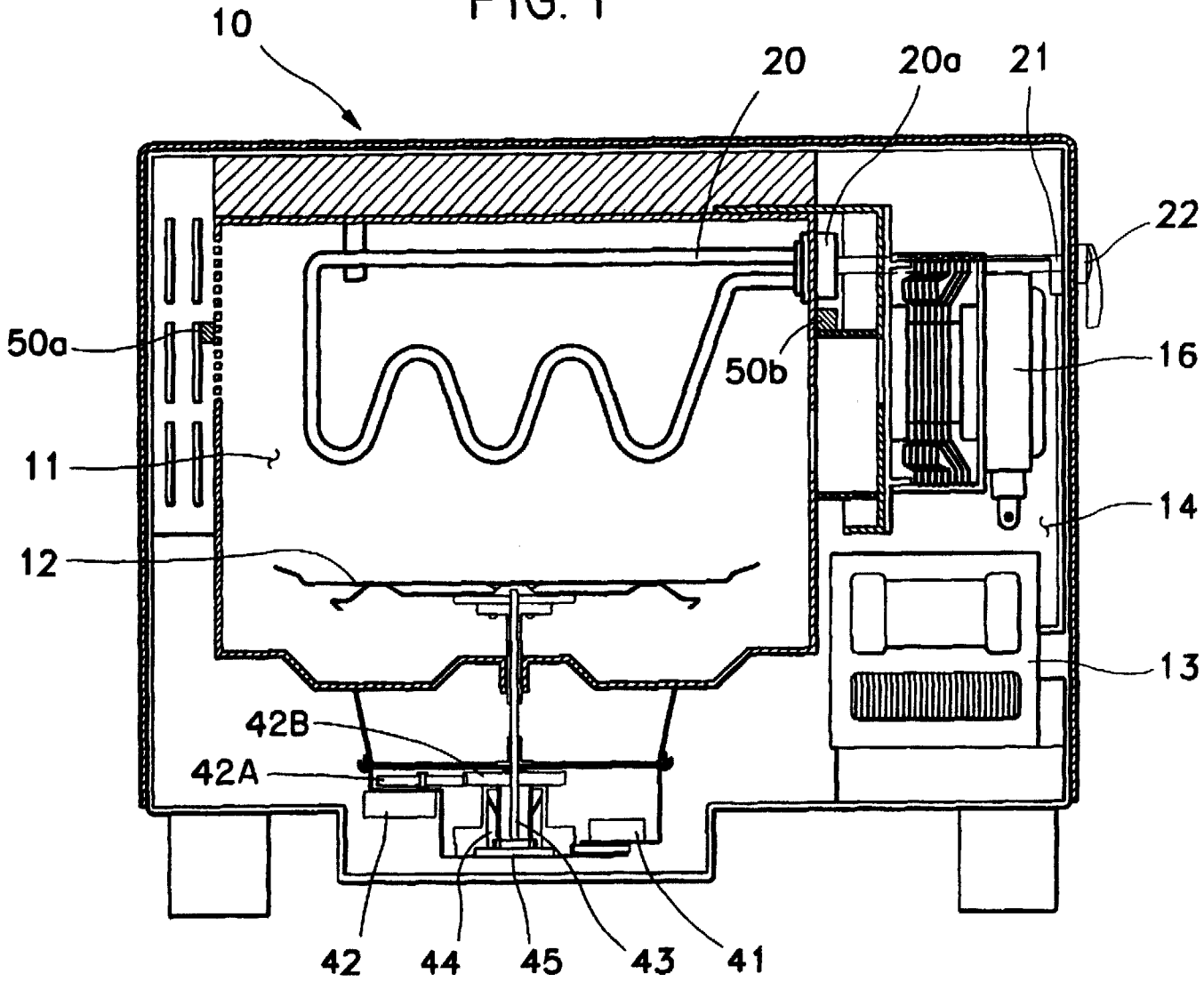
FIG. 1 is a sectional view of the overall construction of a drum washing machine with a balancing device in accordance with the present invention.
Figure 2:
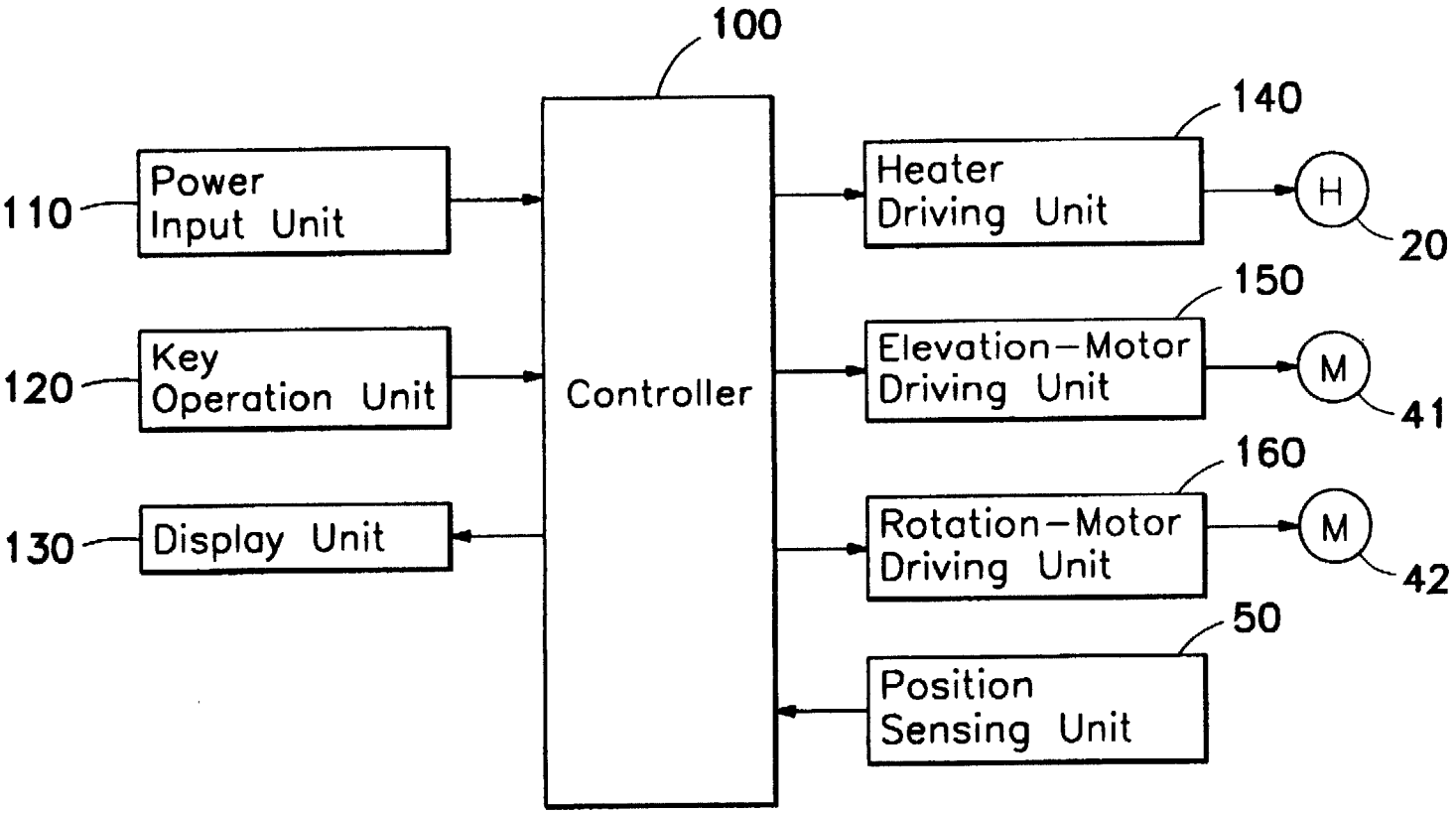
FIG. 2 is a right side view of a spin basket for the drum washing machine of FIG. 1.

FIG. 1 is a sectional view showing the overall construction of a drum washing machine equipped with a balancing device in accordance with the present invention.

As shown in FIG. 1, the drum washing machine includes a housing 10, a tub 20 suspended in the housing 10, and a spin basket 30 rotatably installed within the tub 20. The tub 20 is suspended by a plurality of suspension springs 11 each having one end connected with the inner ceiling of the housing 10 and the other end joined to the outside of the tub 20. A pair of shock absorbing arms 12 are provided under the tub 20.

The spin basket 30, rotatably installed within the tub 20, consists of front and rear panels 31 and 32, and cylindrically-shaped side panel 33 joining the front and rear panels 31 and 32 together. The front panel 31 has an opening **31*a* through which laundry can be put into or taken out of the spin basket 30. A plurality of holes 33*a* are uniformly distributed in the side panel 33. These small holes 33*a* allow water to flow freely between the tub 20** and the spin basket 30, and allow water, removed from laundry during the hydro-extracting process, to drain into the tub 20. Three lifters 33b are formed on the side panel 33 protruding inward in the form of a "V", and are evenly spaced from each other. The lifters 33b raise and drop laundry during washing.

Components used for rotating the spin basket 30 are a shaft 34, a pulley 35 and an electric motor 37. The shaft 34 is joined to the center of the rear panel 32 of the spin basket 30, and is rotatably supported by bearings 23 positioned in a bearing housing 47. A pulley 35 is connected to one end of the shaft 41, and the pulley 35 and the electric motor 37 are connected with each other by a belt 36 so that the rotating force of the electric motor 37 is transmitted to the pulley 35 via the belt 36, thus making the shaft 34 rotate.

The spin basket 30 has a pair of balancing devices 40 each provided to the front and rear panels 31 and 32 so as to counteract the vibrations and imbalances created during rotation. The balancing devices are realized as annular races 41a, 41b, 41a', 41b' that are concentrically formed on inner and outer parts of the front and rear panels 31 and 32, and spherical movable bodies (hereinafter, balls) 42 that are seated in the races 41a, 41b, 41a', 41b'. As described above, the races 41a, 41b, 41a', 41b' are placed on inner and outer parts of the front and rear panels 31 and 32, and the inner race 41a (or 41a') and the outer race 41b (or 41b') protrude inward and outward, respectively. Ball-like counterweights serve as the spherical movable bodies 42, however rollers can alternatively be used, and can be made of plastic.

The respective balls 42 are free to move in each race 41a, and 41b, and oil is held in each race 41a' and 41b' in order to prevent abrasion due to the friction. The races 41a and 41b each have oil supply holes 43a and air vent holes 43b. The oil supply holes 43a are used to provide oil to the races and the air vent holes 43b are used as a passage through which the air in the races be discharged to outside as the oil is being supplied, thereby facilitating the oil supply process.

The oil supply holes 43a are arranged to make a specified angle $\alpha$ with the air vent holes 43b with respect to the rotational center of the spin basket 30 in order to prevent the oil from being discharged through the air vent holes 43b when supplying the oil to the races. It is preferable that the specified angle is no more than 90°. The oil supply holes 43a and air vent holes 43b are sealed by welding after completion of the oil supply process.

Figure 3:
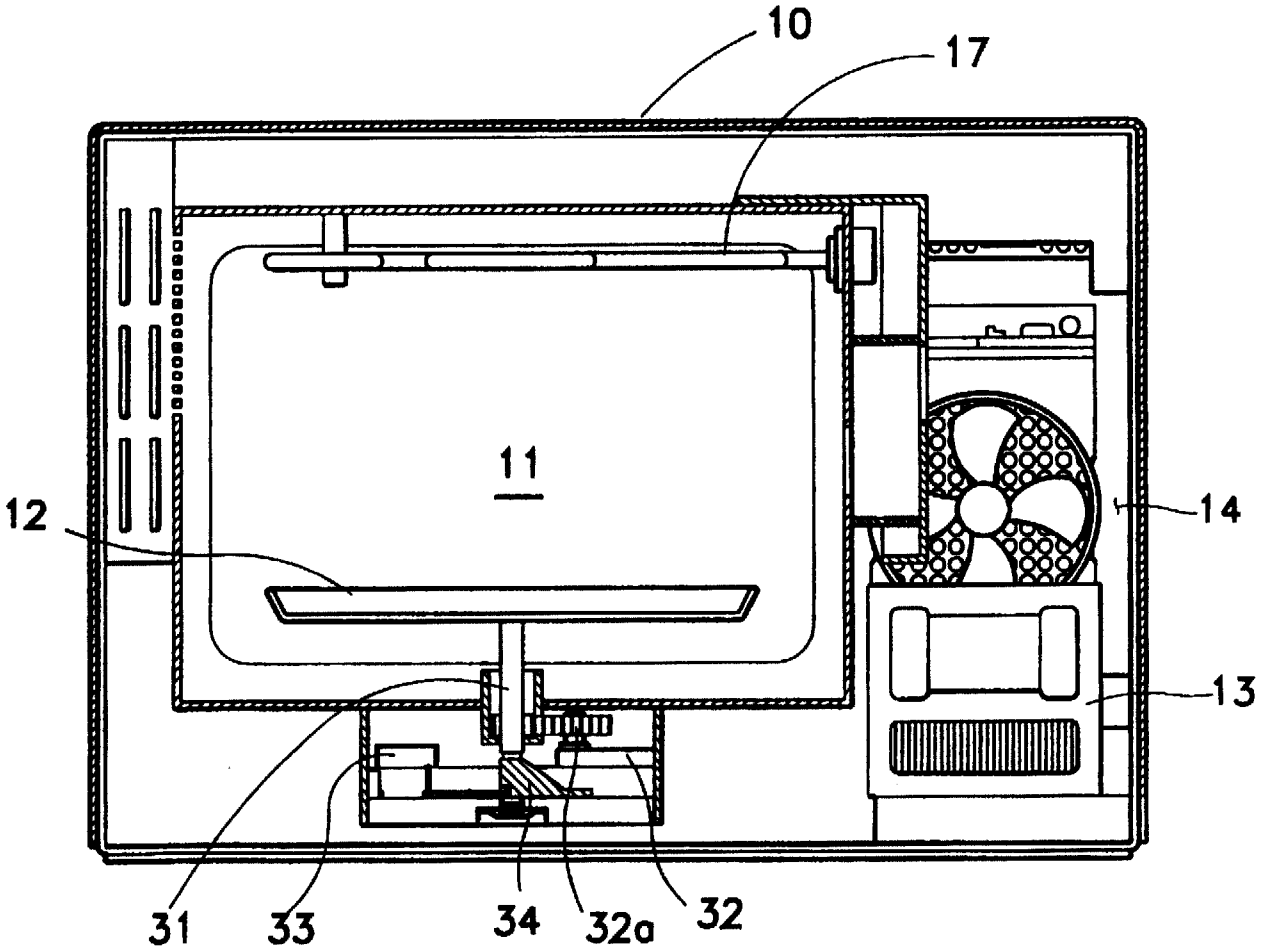
FIG. 3 (PRIOR ART)
FIG. 3 is an enlarged view of a part of the balancing device of the drum washing machine in accordance with the present invention.
Figure 4:
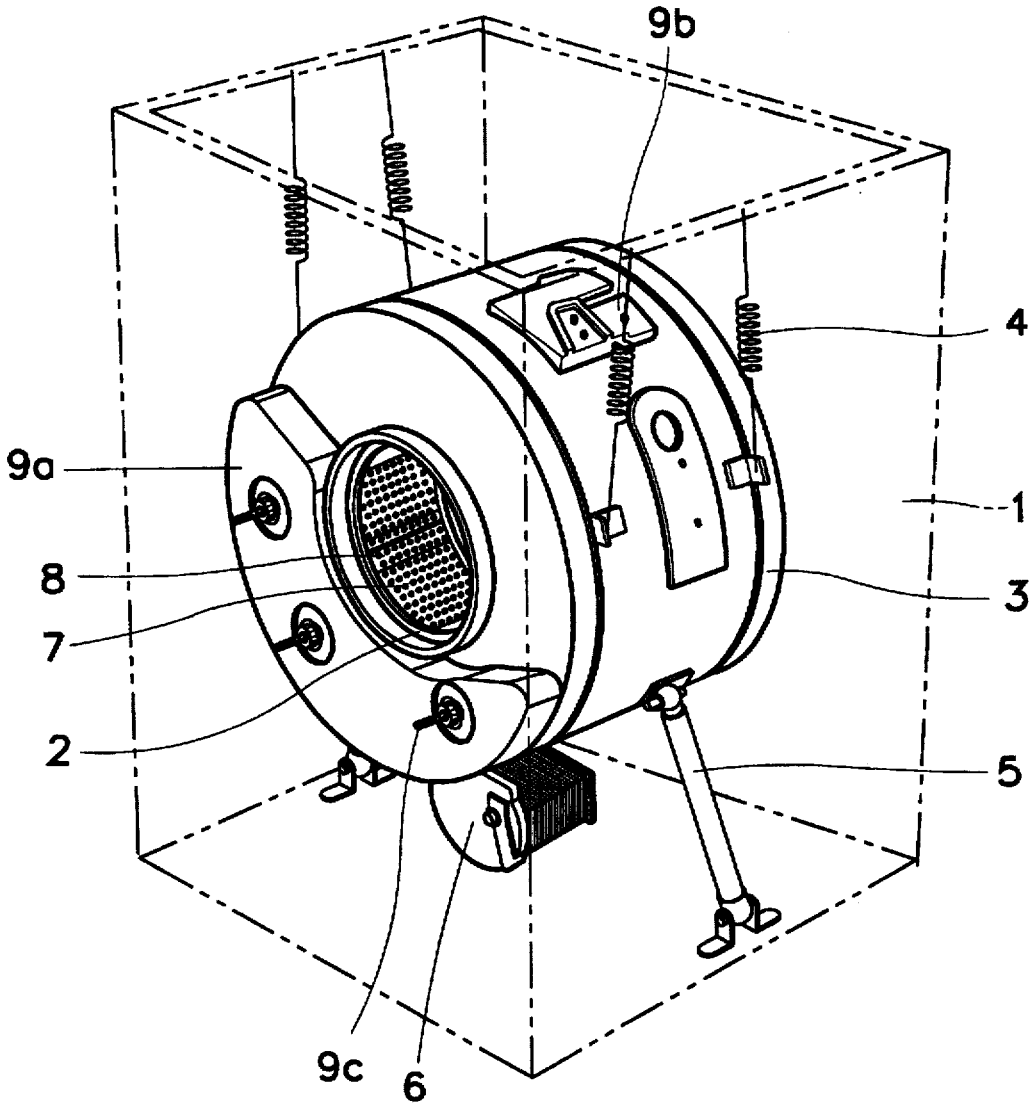
FIG. 4 (Prior Art)
FIG. 4 is a perspective view of a drum washing machine with a balancing device in accordance with a conventional art.
Figure 1:
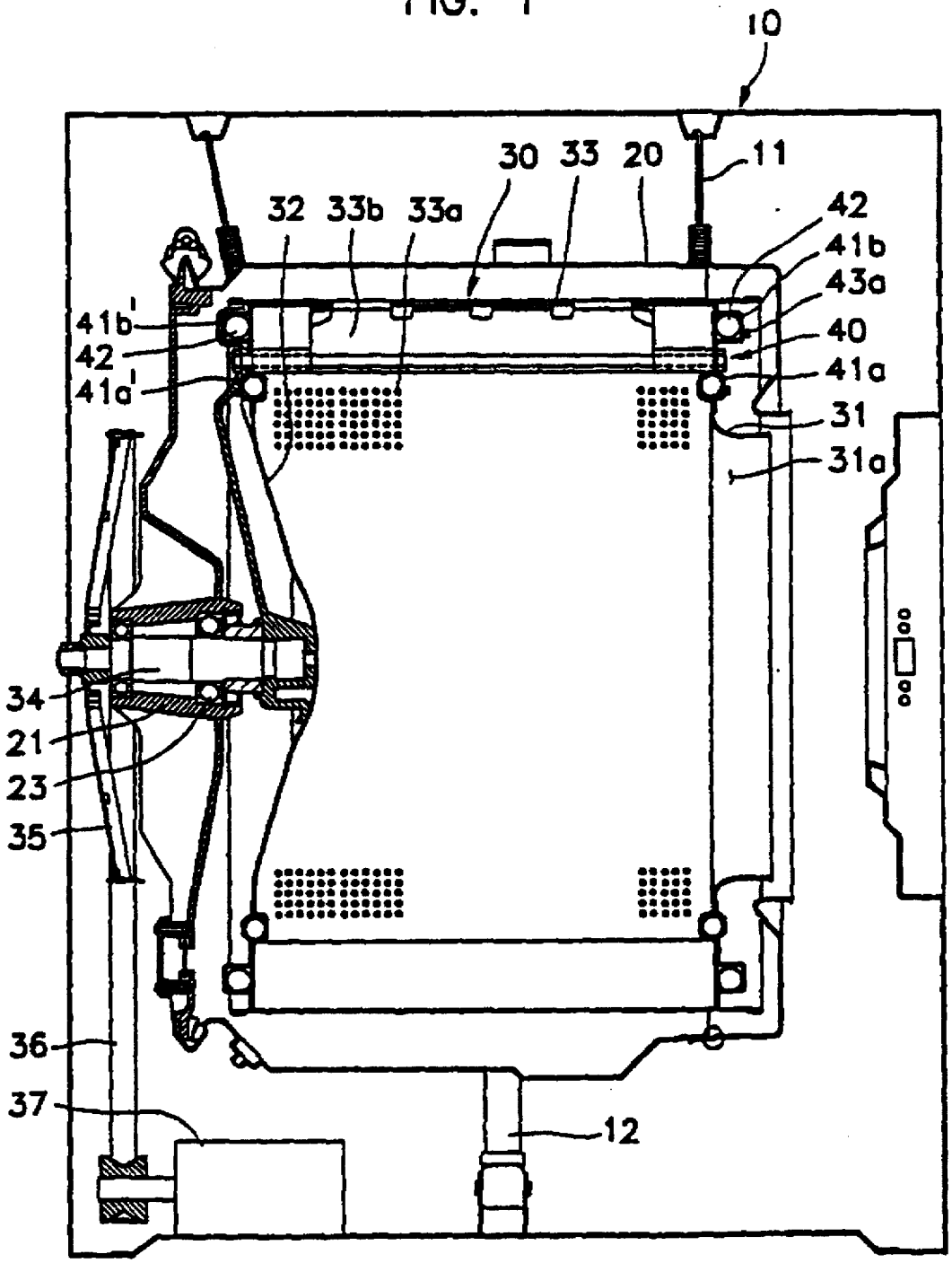
Figure 2:
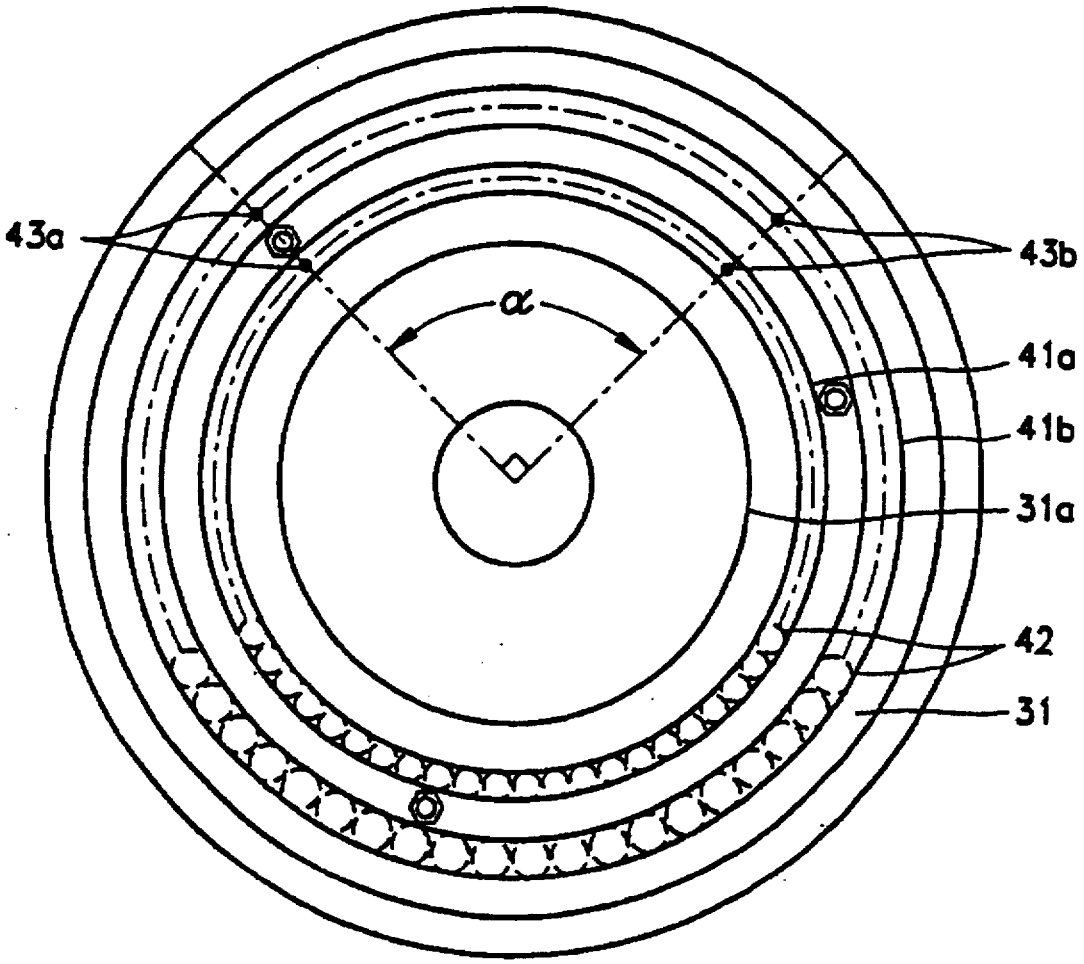
Figure 3:
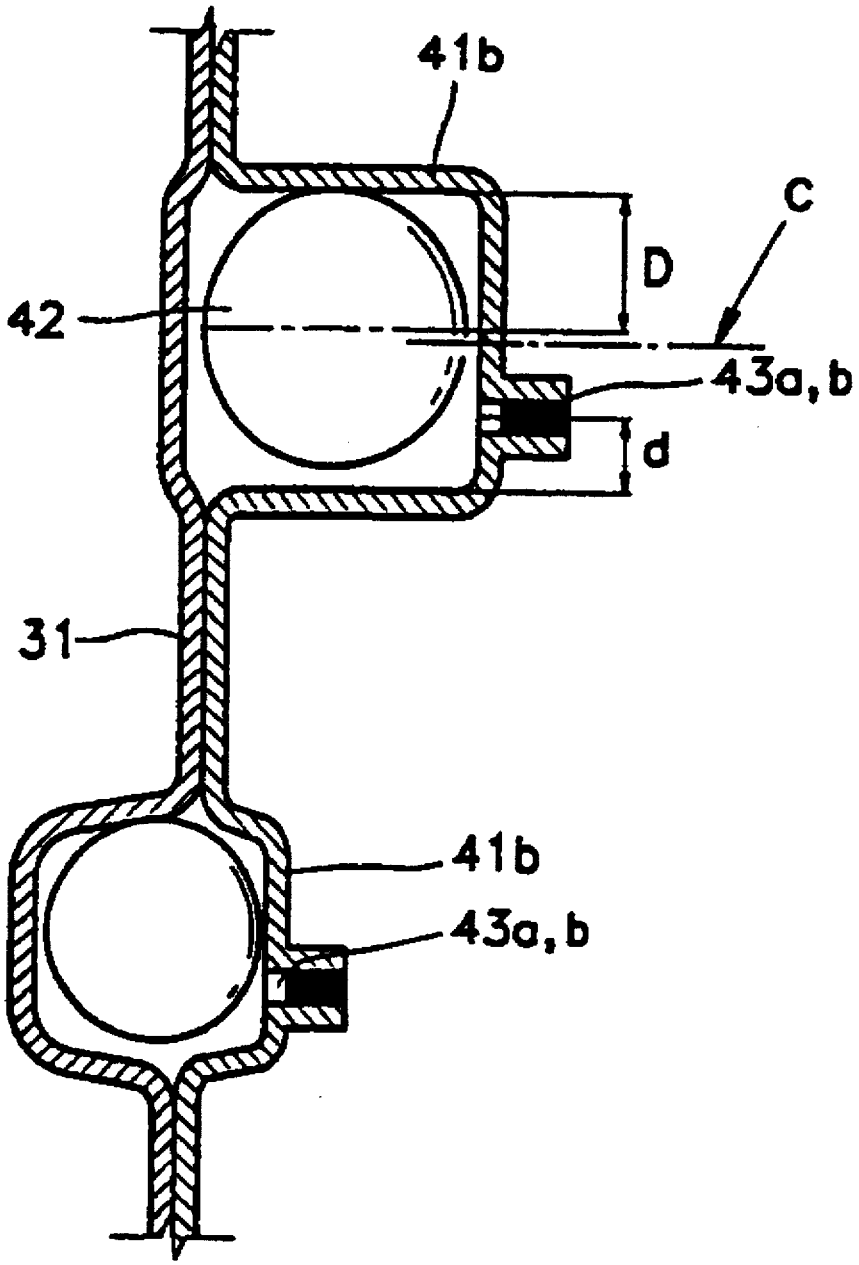
Figure 4:
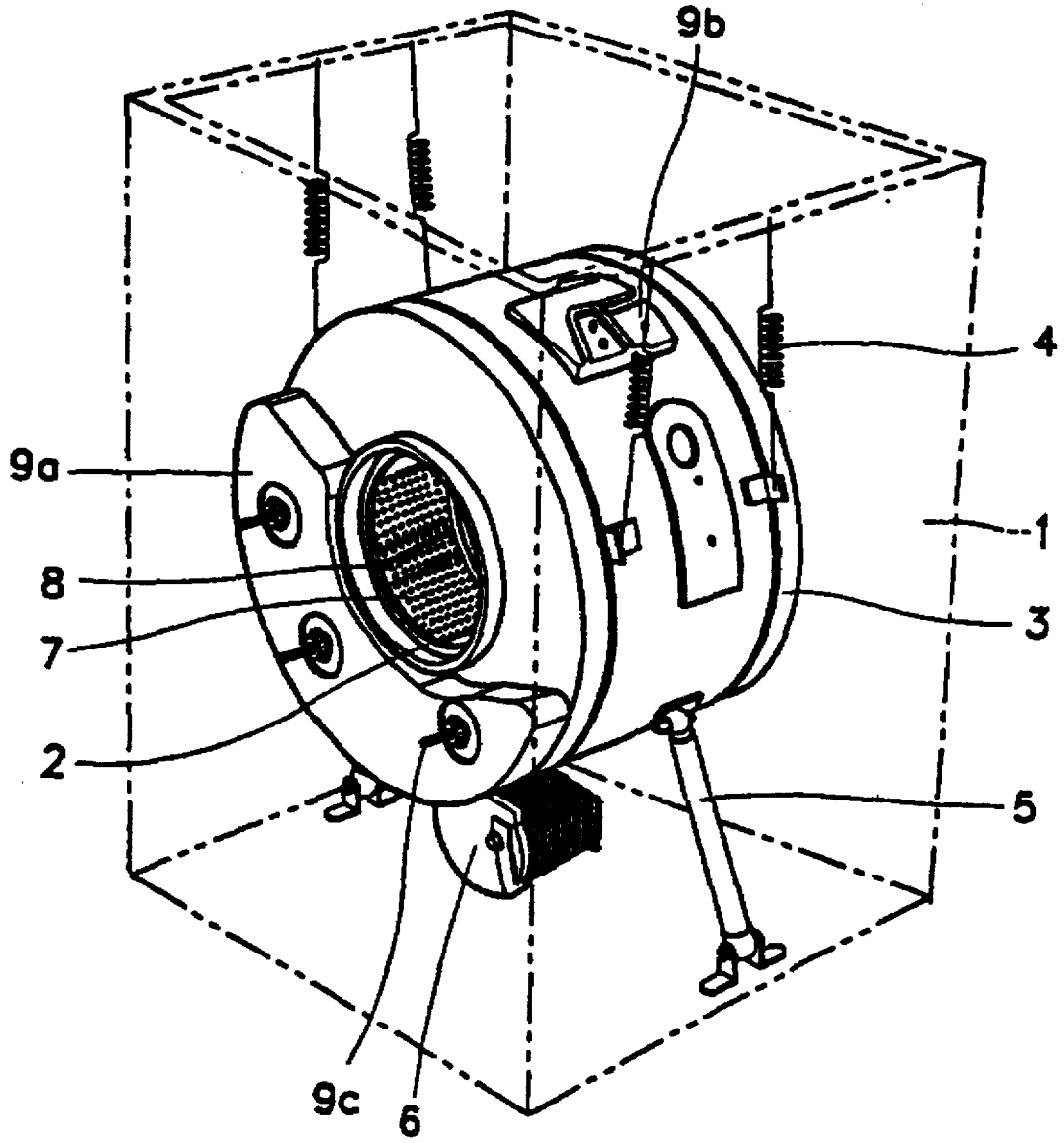
FIG. 4 (Prior Art)

Thus, preferably, the oil supply holes 43a and air vent holes 43b, each provided in the races 41a and 41b of the front panel 31, are formed at the front of the races 41a and 41b, and the oil supply holes 43a and air vent holes 43b, each provided in the races 41a' and 41b' of the rear panel 32, are formed at the rear of the races 41a' and 41b'. The position of each of the oil supply holes 43a and air vent holes 43b is, as shown in FIG. 3, offset downwardly from the center line C of each race. Thus, during rotation of the spin basket, centrifugal force acting on the balls causes the balls to be disposed above, and out of contact with burrs and the like that may be formed during the sealing of the oil supply holes 43a and air vent holes 43b.

More specifically, the oil supply holes 43a and air vent holes 43b are formed on the side wall of each the races, and a distance d between the holes 43a, 43b and the bottom of its respective race is shorter than the ball radius D. This prevents the outer surface of the ball 42 from touching the oil supply holes 43a and air vent holes 43b during movement.

The operation of the balancing device of the present invention will be more fully described as follows.

The drum washing machine rotates forward and reverse on receipt of the rotating force of the electric motor 37 by way of the belt 36. As the spin basket 30 rotates, the laundry inside the spin basket 30 is agitated by the lifters 33b. The high speed rotation of the spin basket 30 removes excess water from the laundry during hydro-extracting process, which then drains into the tub 20 through the holes 33a, and is discharged to outside by a drain device (not illustrated). The balls 42 move along to the opposite side of an imbalance, which is produced by the uneven distribution of clothes in the spin basket 30 by centrifugal force generated by the high-speed rotation of the spin basket 30, thereby dynamically compensating for the imbalance and preventing the vibration and eccentric rotation of the spin basket 30. In the inventive balancing device, oil is held in the races for the smooth movement of the balls 42, and the oil supply holes 43a are arranged to make approximately a right angle with the air vent holes 43b with respect to the center of rotation of the spin basket 30. Therefore, if the oil is supplied to the races through the oil supply holes 43a, the air in each race is discharged through the air vent holes 43b, thus facilitating the oil supply process. In addition, since the respective oil supply holes 43a and air vent holes 43b are formed to avoid contacting the outer surface of each of the balls 42 during operation there will occur no rubbing of the balls 42 against burrs that may have been created during the sealing of the oil supply holes 43a and air vent holes 43b.

The inventive drum washing machine can effectively compensate for the imbalance and prevent vibration and eccentric rotation of the spin basket 30, and facilitate the oil supply to the races. In addition, the sealed oil supply holes and air vent holes do not touch the outer surface of the balls, thus preventing abrasion of the balls due to friction.

What is claimed is:

1. A drum washing machine, comprising:

a housing;

a tub suspended in the housing; and a spin basket mounted in the tub for rotation about a horizontal axis, the spin basket including a plurality of annular balancing races arranged coaxially with respect to the axis, each race containing oil and having balls movably mounted therein, each race including an oil supply hole and an air vent hole spaced angularly from the oil supply hole for venting air during an introduction of oil through the oil supply hole, the oil supply hole and air vent adapted to be sealed.

2. The drum washing machine according to claim 1 wherein the air vent hole and oil supply hole are spaced apart by no more than 90°.

3. The drum washing machine according to claim 1 wherein each race includes a top surface, a bottom surface and axially spaced side walls interconnecting the top and bottom surfaces, the air supply hole formed in one of the side walls, a vertical distance between a center of the air supply hole and the bottom surface being less than a radius of the balls.

4. In a method of fabricating a drum washing machine including a housing, a tub suspended in the housing, and a spin basket mounted in the tub for rotation about a horizontal axis, the spin basket including a plurality of annular balancing races arranged coaxially with respect to the axis, balls movably mounted in the races, and oil contained in the races, the oil being provided by the steps of:

introducing the oil into each race through an oil supply hole formed therein while ejecting air through an air vent formed in the race at an angular spacing from the oil supply hole, and thereafter;

sealing the oil supply hole and air vent.

* * * * *

UNITED STATES PATENT AND TRADEMARK OFFICE

CERTIFICATE OF CORRECTION

PATENT NO. : 5,799,512
DATED : September 1, 1998
INVENTOR(S) : Hyun-Moo Lee et al.

It is certified that error appears in the above-identified patent and that said Letters Patent is hereby corrected as shown below:

The title page showing the illustrative figure should be deleted to be replaced with the attached title page.

Signed and Sealed this

Twenty-second Day of January, 2002

*Attest:*

*Attesting Officer*

JAMES E. ROGAN
*Director of the United States Patent and Trademark Office*

United States Patent [19]

Lee et al.

[11] Patent Number: 5,799,512

[45] Date of Patent: Sep. 1, 1998

[54] BALANCING DEVICE FOR DRUM WASHING MACHINE

[75] Inventors: Hyun-Moo Lee, Suwon; Geum-Chan Lee, Seoul, both of Rep. of Korea

[73] Assignee: Samsung Electronics Co., Ltd., Suwon, Rep. of Korea

[21] Appl. No.: 856,085

[22] Filed: May 14, 1997

[30] Foreign Application Priority Data

May 30, 1996 [KR] Rep. of Korea ..... 96-13840
May 23, 1996 [KR] Rep. of Korea ..... 96-17746

[51] Int. Cl.[6] ..... D06F 37/22

[52] U.S. Cl. ..... 68/23.2; 74/573 F

[58] Field of Search ..... 68/23.2; 210/144, 210/363, 364; 74/573 F, 573 R

[56] References Cited

U.S. PATENT DOCUMENTS

| | | | |
|---|---|---|---|
| 3,733,923 | 5/1973 | Goodrich et al. | 74/573 R |
| 4,044,626 | 8/1977 | Hayashi et al. | 210/144 X |
| 4,787,132 | 11/1988 | Kilgore | 74/573 F X |

*Primary Examiner*—Philip R. Coe
*Attorney, Agent, or Firm*—Burns, Doane, Swecker & Mathis, L.L.P.

[57] ABSTRACT

A drum washing machine includes a tub suspended in a housing, and a spin basket rotatably mounted in the tub. Each spin basket includes oil-filled races that are coaxial with the spin basket, a plurality of balls movable in the races, and oil disposed in the races. The oil is introduced into each race through an oil supply hole while forcing air out through an air vent which is angularly spaced from the oil supply hole, e.g. by 90 degrees.

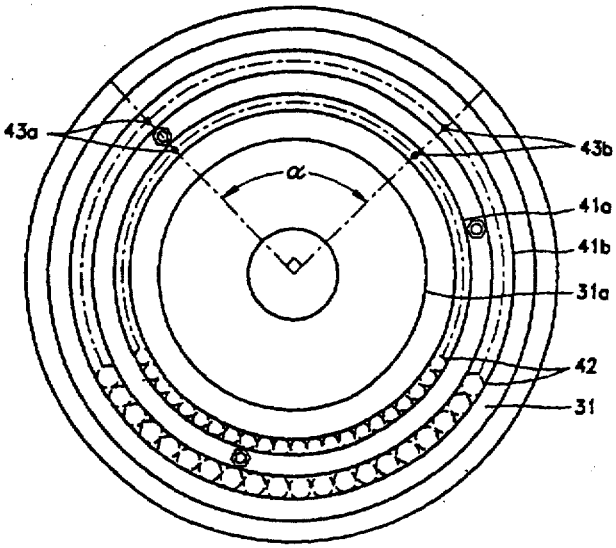

4 Claims, 4 Drawing Sheets